United States Patent [19]

Burandt

[11] Patent Number: 4,459,946

[45] Date of Patent: Jul. 17, 1984

[54] VALVE ACTUATING APPARATUS UTILIZING A MULTI-PROFILED CAM UNIT FOR CONTROLLING INTERNAL COMBUSTION ENGINES

[75] Inventor: Corliss O. Burandt, Plymouth, Minn.

[73] Assignee: Investment Rarities, Incorporated, Minneapolis, Minn.

[21] Appl. No.: 378,843

[22] Filed: May 17, 1982

[51] Int. Cl.[3] ..... F01L 1/08; F01L 1/22

[52] U.S. Cl. ..... 123/90.16; 123/90.44; 123/90.6

[58] Field of Search ..... 123/90.12, 90.15, 90.16, 123/90.17, 90.2, 90.27, 90.39, 90.44, 90.45, 90.52, 90.6

[56] References Cited

U.S. PATENT DOCUMENTS

| | | | |
|---|---|---|---|
| 2,260,983 | 10/1941 | Walker | 123/348 X |
| 2,410,660 | 11/1946 | Howard | 123/90.16 |
| 3,413,965 | 12/1968 | Gavasso | 123/90.16 |
| 4,153,016 | 5/1979 | Hausknecht | 123/90.55 X |
| 4,203,397 | 5/1980 | Soeters, Jr. | 123/90.16 |
| 4,205,634 | 6/1980 | Tourteldt, Jr. | 123/90.16 X |

*Primary Examiner*—William R. Cline
*Assistant Examiner*—Peggy A. Neils
*Attorney, Agent, or Firm*—Peterson, Palmatier, Sturm, Sjoquist & Baker, Ltd.

[57] ABSTRACT

In a specific embodiment a cam unit comprised of three differently profiled cams acts on follower portions or working surfaces on a shiftable first rocker arm to cause a second rocker arm to open and close a valve associated with the combustion chamber or cylinder of an internal combustion engine in accordance with the cam profiles and the contours of the follower surfaces to (1) maintain the valve completely closed, such as during engine deceleration, (2) vary the valve duration and produce a lesser valve lift to effect an engine throttling mode of operation, and (3) vary the valve duration and produce a greater valve lift for a higher engine performance.

20 Claims, 5 Drawing Figures

VALVE ACTUATING APPARATUS UTILIZING A MULTI-PROFILED CAM UNIT FOR CONTROLLING INTERNAL COMBUSTION ENGINES

CROSS-REFERENCE TO RELATED APPLICATION

My co-pending application titled "Variable Valve Operating Mechanism for Internal Combustion Engines", Ser. No. 310,655 filed on Oct. 13, 1981, contains subject matter related to this application.

BACKGROUND OF THE INVENTION

1. Field of the Invention

This invention relates generally to internal combustion engines, and pertains more particularly to apparatus for smoothly controlling the time at which an intake valve opens and closes, maintaining the valve closed under certain operating conditions, and also controlling the amount of lift or degree of valve opening.

2. Description of the Prior Art

A relatively large number of mechanisms have been devised for controlling the opening and closing of intake and exhaust valves for internal combustion engines. Two such prior art constructions are described in U.S. Pat. No. 1,395,851, issued Nov. 1, 1921, to Francis B. McLean for "Valve Operating Mechanism" and in U.S. Pat. No. 2,412,457, issued on Dec. 10, 1946 to Laurence D. Harrison for "Valve Actuating Mechanism". Both of these patents have been mentioned in my said related co-pending application.

U.S. Pat. No. 2,934,052, granted on Apr. 26, 1960 to Irvin R. Longenecker for "Valve Operating Mechanism" and U.S. Pat. No. 4,205,634, granted on June 3, 1980 to Edward M. Tourtelot, Jr. for "Variable Valve Timing Mechanism" depict arrangements for operating an internal combustion engine in different speed or efficiency modes. Both of these patentees are primarily concerned with changing the timing and not lift for two different operating modes. Hence, the ability to quickly shift between performance and economy operating modes required in modern-day internal combustion engines, especially those installed on vehicles, is lacking from the variable valve timing mechanism described in these last-mentioned patents.

The patented arrangements will produce a considerable amount of wear, thereby increasing the lash unless appropriate compensating adjustments are made (or in the alternative, employing relatively costly hydraulic valve lifters).

SUMMARY OF THE INVENTION

Accordingly, a general object of my invention is to provide valve actuating apparatus that will be exceedingly versatile in controlling timing, lift and duration.

Also, an important object of my present invention is to effect appreciable changes in valve movement in a minimum amount of time and for only a limited amount of movement of the control member to which my apparatus is intended to respond. Stated somewhat differently, with my invention, there need be only a very simple and limited amount of command movement and this movement is effectively converted into an appreciable amount of valve movement at precise times, the increased amount of valve movement being derived in an extremely brief interval of time. More specifically, an aim of this invention is to derive virtually zero valve movement at appropriate times. In this regard, where the valve should remain completely closed, such as when the engine is decelerating, my invention enables the intake valve to be kept closed until such time as fuel is again required. On the other hand, up to as much as one-half inch of valve (or even more) opening or lift can be realized when the engine is accelerating and an increased mixture of fuel and air is needed.

The invention has for an additional object the achieving of a more precise timing control, that is, when the valve begins to open and when the valve closes, as well as the amount of lift or duration of opening that is required for a particular operating mode.

Regarding the foregoing object, where my invention is utilized in controlling the valves on a vehicle's internal combustion engine, the valves may be held closed to effect a compression release or conventionally opened and closed to produce a braking action. Control can be effected in a manner such that the engine can be used as a "brake" during deceleration periods.

Another object of the instant invention is to minimize the amount of wear of those parts utilized in the opening and closing of an inlet valve. This is accomplished through the agency of take-up ramp portions and lifting areas. In the case of a vehicle equipped with an engine having my invention incorporated thereon, the valves would travel a lesser distance per mile than when conventional valve operating mechanisms are employed. Consequently, even though so-called solid or non-hydraulic valve lifters have, in the past, required frequent adjustments, the appreciable reduction in the amount of wear achievable with my invention reduces the necessity for making such adjustments. Consequently, an aim of the invention is to obviate the need for hydraulic lifters, hydraulic lifters having previously been utilized mainly for the reason that they require little or no adjustment. Consequently, a saving in costs can be achieved when utilizing the teachings of my present invention by merely using non-hydraulic valve lifters in contradistinction to more expensive hydraulic lifters.

The invention also has for an object the provision of apparatus for adjusting both valve timing and lift that will have a relatively long life, thereby reducing maintenance and replacement costs.

Still further, an object of the invention is to provide apparatus of the foregoing character that will be quite compact, this being an important consideration where space is severely limited, such as normally true in the case of engines installed in automobiles.

Yet another object is to substantially reduce thrust levels imposed on the camshaft caused by sudden demands for a drastic change in the amount of valve lift, the severe forces which result and which are transmitted to the camshaft produce periods of instability. Over a period of time such forces produce an increased amount of wear, which has herein already been mentioned as being objectionable.

Another object is to reduce the quantity of exhaust emissions via the simple expedient of keeping the intake valve closed when engine power is not needed, such as during periods of deceleration, for if no fuel and air is drawn into the combustion chamber or cylinder, there are no exhaust gases to contend with and hence no emissions. It is also within the contemplation of the invention to relate the opening and closing of an intake valve with respect to the closing and opening of an exhaust valve. When this particular object is correlated with the preceding object, the preceding object dealing with the automatic closing of the intake valve during deceleration, it becomes obvious that without an induction of fuel and air into the combustion chamber or cylinder, there can be no exhaust emissions. Yet the timing, that is, when the inlet valve starts to open and when it starts to close (or when it reaches its completely open position and/or when it reaches its completely closed position) can be related to the opening and closing of the exhaust valve associated with that particular combustion chamber. Thus, it is possible when practicing my invention to have the period in which the exhaust valve is open overlap somewhat the opening of the intake valve so that where exhaust gases are present by reason of the inlet valve being open for an operating mode not specifically tied to the actual operating mode, some of the exhaust gases will be drawn back into the cylinder to assure that emissions will be held to an absolute minimum for whatever operating condition is, at that moment, being experienced by the engine. Hence, the need for external exhaust gas recirculation (EGR) is for all intents and purposes obviated.

Whereas the object immediately above deals with the capability of being able to keep the intake valves closed when no fuel is needed, my invention has the further advantage of being able to use the intake valve to throttle the charge of fuel and air just as it enters the combustion chamber. The venturi action that results increases the velocity and turbulence with a concomitant vaporization and mixing enhancement that assures better ignition within the combustion chamber. Many carburetor and camshaft control mechanisms can be greatly simplified (or even eliminated).

Briefly, my invention contemplates the employment of a cam unit having several different cam profiles formed thereon. The several cams, in a specific embodiment, act against an upper rocker arm that is formed with appropriately contoured cam follower portions or working surfaces, each intended to be engaged by a particular cam. The upper rocker arm is shiftable into various positions relative to the cam unit by means of a control or command mechanism, such as an accelerator pedal. Thus, by having the cam follower portions contoured in correlation with the profiles of the cams, the prescribed action of each cam can be transmitted via the upper rocker arm to a lower rocker arm.

The upper rocker arm, being longitudinally shiftable relative to the lower rocker arm, can change the amount of rocking movement of the lower rocker arm. Inasmuch as the lower rocker arm bears against the upper end of the valve to be opened and closed, the particular moment at which the valve can be opened can be controlled, as well as the time at which the valve is permitted to close. In this regard, the valve can be maintained in a closed condition so that no fuel/air charge is inducted into the combustion chamber. This particular action is derived from a cam having a base circle portion and an eccentric portion that compensates for lash. Where the charge to be admitted into the combustion chamber is to be relatively small, such as during an economy operating mode, then a cam having a minor lobe thereon is instrumental in opening the inlet valve a lesser amount; in other words, the valve lift is reduced. On the other hand, when considerable power is needed by the engine equipped with my invention, such as during a high performance mode, a cam having a larger lobe opens the valve a greater amount so that a greater amount of mixed fuel and air, under these conditions, is drawn into the combustion chamber.

DESCRIPTION OF THE PREFERRED EMBODIMENT

Figure 1:
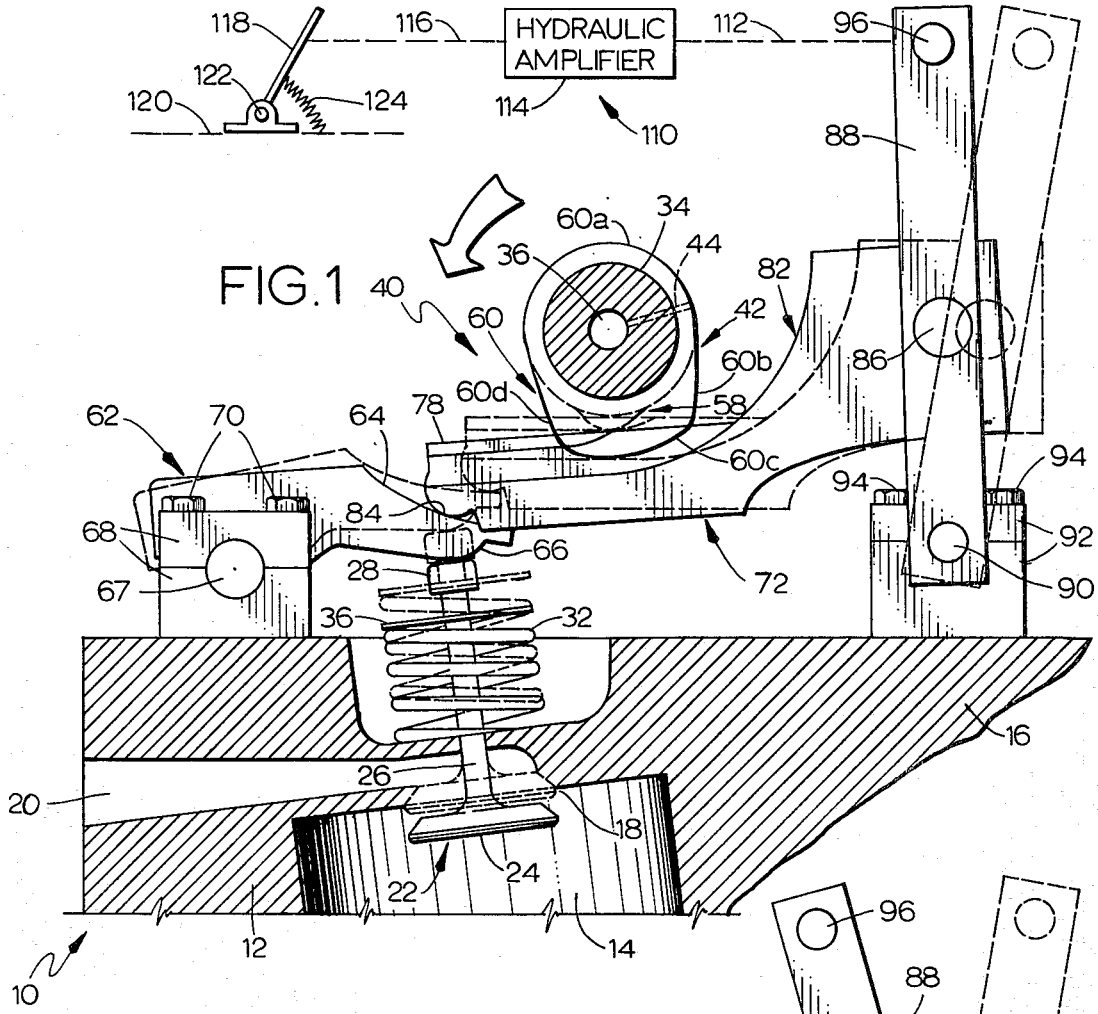
FIG. 1 is a diagrammatic view illustrating my valve adjusting apparatus in an economy or cruise mode, the phantom line position depicting the valve closed and the solid line position showing the valve open but to a lesser degree than that appearing in FIG. 2.
Figure 2:
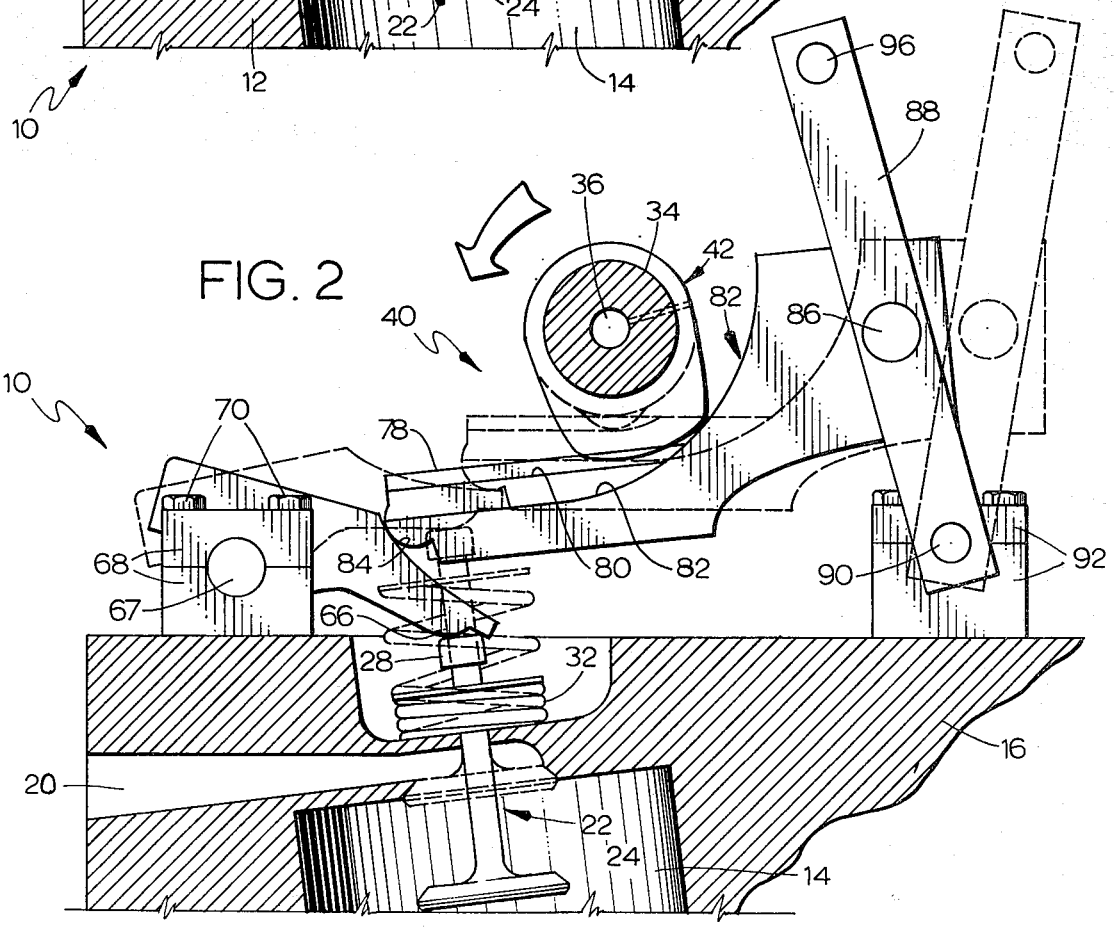
FIG. 2 is a view somewhat similar to FIG. 1 depicting a performance mode in which the phantom line position again shows the valve closed and in which the solid line position again shows the valve open but to a greater degree than in FIG. 1, the increased lift appearing in FIG. 2 being exaggerated in order to have better visual advantage of the difference in valve positions.
Figures 3, 4, 5:
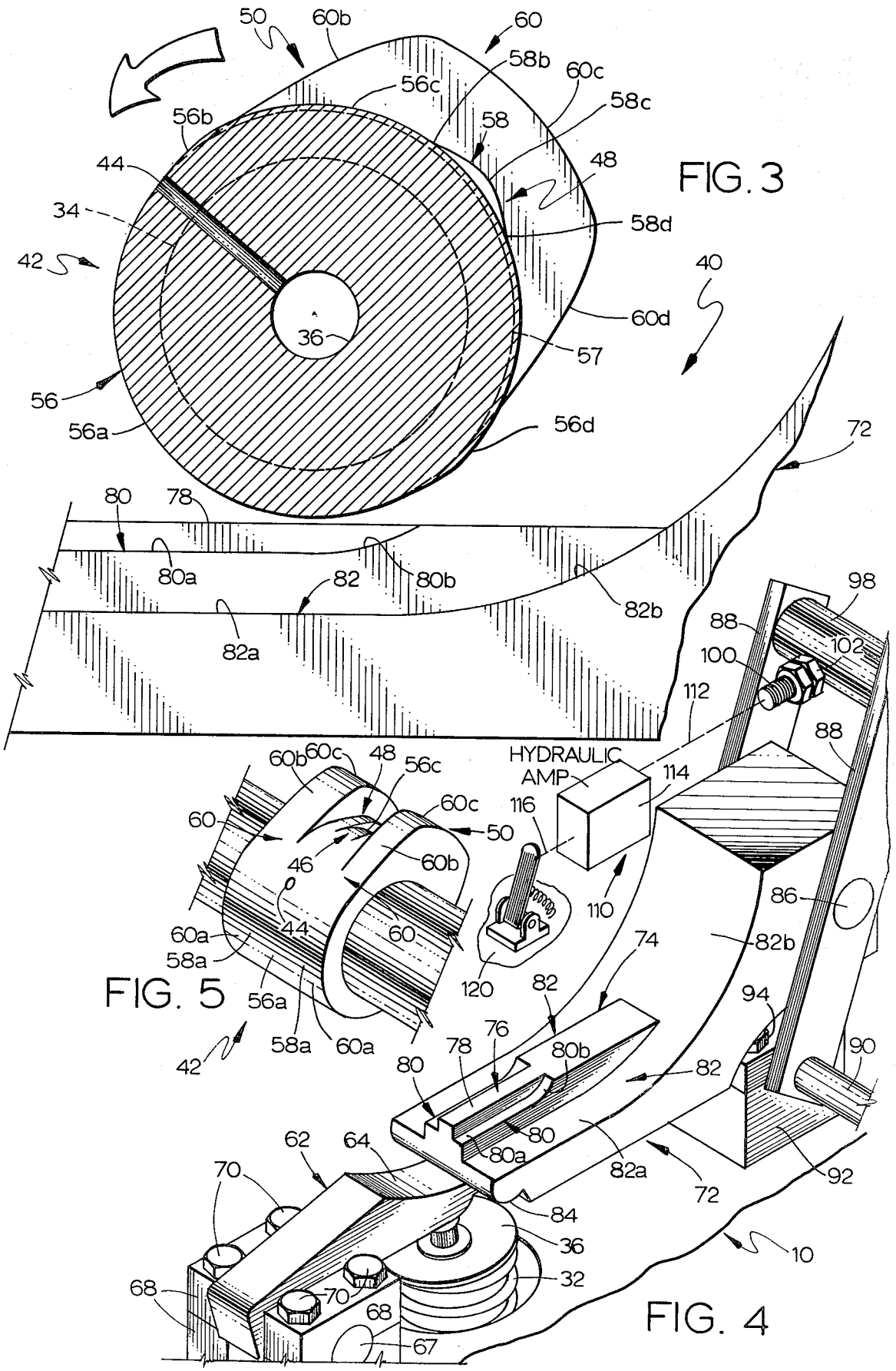
FIG. 3 is a sectional view taken centrally through the cam unit of FIG. 5 but with a side elevational (not in section) portion of the upper rocker arm included therebeneath.
FIG. 4 is a perspective view of a portion of my valve actuating apparatus, the cam unit removed so as to expose to view several cam follower portions that would otherwise be cancealed.
FIG. 5 is a perspective view of the cam unit without the upper rocker arm present.

Referring to the drawings, a conventional internal combustion engine 10 has been fragmentarily depicted in FIGS. 1, 2 and 4. The engine 10 includes a cylinder block 12 containing a combustion chamber or cylinder 14 therein, being one of any number of cylinders. Associated with the cylinder block 12 is a cylinder head 16. An inlet valve port 18 has a passage 20 connecting with the intake manifold (not shown) of the engine 10.

Conventionally included is an inlet valve indicated generally by the reference numeral 22. More specifically, the inlet valve 22 includes a head 24 having a beveled surface that effectively closes the inlet port 18 when the valve has moved sufficiently upwardly. The valve 22 further includes a stem 26 having a lash cap 28 mounted at its upper end. A retainer 36 maintains a coil spring 32 captive so that the valve 22, that is, its head 24, is biased upwardly into a closed or seated position when not forced open, all as will presently become manifest.

Connected to the crankshaft (not shown) in a conventional manner is a camshaft 34. In this instance, the camshaft 34 is tubular, having a passage or bore 36 extending therethrough so that oil can be transmitted for lubricating purposes presently to be referred to.

The foregoing has dealt with parts of a conventional engine. Nonetheless, it has been thought important to show and describe sufficient parts of a conventional engine, such as that denoted generally by the reference numeral 10, in order that the operation of my valve actuating apparatus, denoted generally by the reference numeral 40, can better be understood. It will be appreciated that the apparatus 40 comprises a cam unit or eccentric assembly indicated by the reference numeral 42, the cam unit 42 being fixedly carried on the camshaft 34. The hollow configuration of the camshaft 34 has been referred to so it should now be noted that there is an oil hole or passage 44 provided in the cam unit 42 which hole or passage 44 connects with the bore 36 so that oil will be discharged radially outwardly through the hole 44 onto parts presently to be referred to.

The cam unit 42 plays a very important role in realizing the objects of my invention. First, attention is called to the presence of a divorced base circle cam indicated by the reference numeral 46, this cam 46 being centrally located on the unit 42. Actually, the sectional view appearing in FIG. 3 extends through the centrally located base circle cam 46. Flanking the base circle cam 46 are two identical minor lobe cams 48. The cam unit 42 additionally includes another pair of identical cams, these being major lobe cams that carry the reference numeral 50.

The base circle cam 46 has a profile or contour denoted generally by the reference numeral 56, the profile 56 consisting of a base circle portion 56*a* which subtends an arc of slightly less than 180 camshaft degrees, a short sloping ramp portion 56*b* of only a few camshaft degrees inclining outwardly to an increased radius eccentric or divorce portion 56*c* differing in radius from the radius of the base circle portion 56*a* by about 0.010 inch (or whatever the expected lash happens to be) and also spanning an arc slightly less than 180 camshaft degrees, and an inwardly sloping ramp portion 56*d* extending over the same small camshaft angle as the portion 56*b*, the portion 56*d* decreasing in radius from the larger radius portion 56*c* back to the radius of the base circle portion 56*a*. In order for the eccentricity of the portion 56*c* to be noticed, an arc 57 having the same radius as the base circle portion 56*a* has been superimposed on FIG. 3, that is, radially inwardly from the portion 56*c* by an amount equal to the lash to be compensated for.

The profile for the minor lobe cams 48, both of which are identically contoured, has been labeled 58, being composed in each instance of a base circle portion 58*a* having a radius equal to that of the base circle portion 56*a* of the profile 56 on the cam 46, the portion 58*a* spanning the same arc as the same base circle portion 56*a*, a ramp portion 58*b* of only a few degrees that increases in radius to a lobe portion 58*c* of somewhat larger radius and subtending an angle of approximately 15 degrees, and a sloping ramp portion 54*d* that decreases in radius from the lobe portion 58*c* back to the radius of the base circle portion 58*a* (and the radius of the base circle portion 56*a*).

Although configured differently, the profile, which has been indicated by the reference numeral 60, for the cams 50 includes in each instance a base circle portion 60*a* embracing the same arc and having the same radius as the base circle portions 56*a* and 58*a*, a sloping ramp portion 60*b* extending over an arc of 20 degrees or so and increasing in radius to a lobe portion 60*c* subtending an arc of approximately 35 degrees, and a sloping ramp portion 60*d* that decreases in diameter back to the base circle portion 60*a*, the portion 60*d* extending over an angle generally equal to that of the portion 60*b*.

At this time, attention is directed to a lower rocker arm denoted by the reference numeral 62. The rocker arm 62 is formed with a ramp section 64 that curves upwardly from the right end, as can be seen from FIGS. 1, 2 and 4. Integral with the underside of the right end of the rocker arm 62 is a rounded nub 66 that engages the lash cap 28 at the upper end of the valve stem 26. The lower rocker arm 62 is mounted for pivotal movement on a shaft 67 providing a fixed axis; the shaft may be tubular. The shaft 67 is clamped in place by reason of blocks 68 having hold-down bolts 70 extending downwardly therethrough into the head 16. As will be discerned from FIG. 4, there are two sets of blocks 68, the lower rocker arm 62 being pivotally mounted on the shaft 67 between the two pairs of blocks 68 which prevent lateral shifting of the rocker arm 62 on the shaft 67. It will be appreciated that the rocker arm 62, which has the rounded nub 66 thereon, is instrumental in acting against the lash cap 28 so as to open and close the valve 22.

It will be observed that the shaft 67 has been shown as being quite short; actually, it can extend the entire length of the head 16 so as to accommodate a rocker arm 62 for each of the inlet valves, say four if the engine is a four-cylinder one, since there is one inlet valve 22 for each cylinder or combustion chamber 14. In practice, there is also an exhaust valve (not shown) for each cylinder or combustion chamber 14. However, it is thought that showing but a single inlet valve 22 will be adequate for understanding the benefits to be derived from my invention.

Reference will now be made to an upper rocker arm 72 having a composite ramp or follower section indicated generally by the reference numeral 74. In a sense, the ramp section 74 can be considered to possess a stepped configuration when viewed from the left end in FIG. 4. Thus, there is a rib 76 that is centrally located, the rib 76 provides a central flat follower portion or working surface 78 that is engaged by the divorced base circle cam 46. There are two flanking follower portions or working surfaces 80, the portions 80 in each instance including a straight section 80*a* and a curved section 80*b*. The portions 80, it will be understood, are engaged by the minor lobe cams 48. Still further, there are two outer follower portions or working surfaces 82, each being composed of a straight section 82*a* and a curved section 82*b*. More will be said presently concerning the coaction of the cam unit 42 with the composite ramp section 74, especially the interrelation of the profiles 56, 58 and 60 with the follower portions 78, 80 and 82, respectively. It will be noted, though, that the left or free end of the upper rocker arm 72 is formed with an integral rounded pad 84 which bears against whatever portion of the ramp section 64 over which it is positioned.

The end of the upper rocker arm 72 remote from the end thereof having the rounded pad 84 thereon is pivotally carried or mounted on a relatively short shaft 86, the ends of the shaft 86 being mounted in parallel strips or arms 88. The lower ends of the arms 88 are pivotal on a shaft 90 clamped in blocks 92 by means of hold-down bolts 94 that extend into the head 16 in much the same manner as do the earlier-mentioned bolts 70. Disposed between the arms 88 at the upper ends thereof is a shaft 96 having a sleeve 98 rotatably carried thereon. In this way, the sleeve 98 can oscillate or swivel about the shaft 96. Extending from the sleeve 98 is a threaded rod 100 that is radially received in the sleeve 98, being held in place by lock nuts 102.

What will be termed an operating mechanism, which has been denoted generally by the reference numeral 110, includes a rod 112 which is actually the extension of the threaded rod 100. It is not believed necessary to show the extension 112 in any detail. However, it connects with a hydraulic servomechanism or hydraulic amplifier labeled 114. There is still another rod 116 that links the hydraulic servo 114 to an accelerator pedal 118 that is pivotally attached or mounted at its lower ends to the floorboard 120 of a vehicle by means of a pivot pin 122. Biasing the accelerator pedal 118 in a clockwise direction, as viewed in FIG. 1, is a coil spring 124. Thus, whereas the accelerator pedal 118 could be connected directly to the upper end of the parallel arms 88 via the sleeve 98, it is better to have the foot pressure exerted on the pedal 118 amplified. Actually, where my invention is incorporated into engines other than those installed on a vehicle, the arms 88 can be manually actuated.

Having presented the foregoing description, the manner in which my valve actuating apparatus operates should be readily understood. Nevertheless, in order to assure a full appreciation of the benefits to be derived, several operating modes will be referred to.

First, during deceleration, there is no need for fuel to be drawn into the combustion chamber 14 of the exemplary engine 10. With my invention, this is achieved by removing foot pressure from the pedal 118. This results in the hydraulic amplifier 114 pivoting the arms 88 in a clockwise direction beyond the phantom line position of FIG. 1 (or FIG. 2) with the consequence that the upper rocker arm 72 is shifted or pulled sufficiently to the right so that only the base circle portions 56*a*, 58*a* and 60*a* of the cams 46, 48 and 50, respectively effectively engage the rocker arm 72. (When the amplifier 114 is not used, the direct linkage comprised of the links 112, 116 would be employed.) As the camshaft 34 rotates, the base circle portion 56*a* and the eccentric or divorced portion 56*c* successively act against the flat portion 76, the sloping or ramp portions 56*b* and 56*d* producing a smooth transition during each revolution. The point to be understood, though, is that the valve 22 remains closed during this operational mode, for the increased radius of the eccentric portion 56*c* only compensates for whatever clearance or lash exists. With the valve 22 closed, it is obvious that no fuel/air charge enters the combustion chamber 14. With no fuel in the chamber 14, there is no combustion and hence no exhaust gases and emissions.

However, when the engine 10 is to operate in a low performance manner, such as when cruising, it follows that the accelerator 118 will be only slightly depressed by the vehicle driver. This illustratively produces the position of the arms 88 and the upper rocker arm 72 presented in solid outline in FIG. 1. Under these circumstances, the two minor lobe cams become effectual, their profiles 58 bearing against the twin follower portions 80 on the rocker arm 72. Obviously, the amount of mixed fuel and air is throttled down more under these conditions than the conditions portrayed in FIG. 2. It will be appreciated that the amount of valve opening, the change from phantom to solid line position, has been exaggerated somewhat in order to avoid an overlap of solid and phantom lines in the drawing. However, with a small amount of valve opening, which is caused by the lobe portions 58*c* acting against the follower portions 80, it will be appreciated that a venturi action results in which the velocity of the fuel/air charge entering the combustion chamber 14 via the port 18 is increased with an accompanying increase in turbulence, which contributes appreciably to more complete ignition due to atomization of the fuel/air mixture at the last possible opportunity prior to combustion.

In a performance mode, however, the amount of fuel and air must be increased. This is achieved by forcing the valve 22 open to a greater extent. This is done in the exemplary case by depressing the accelerator pedal 118 so that the amplifier 114 pivots the arms 88 into their solid line position pictured in FIG. 2. In this situation, the lobe portions 60*c* act against the two outer follower portions 82 on the rocker arm 72. Since the lobe portions 60*c* extend a greater radial distance from the camshaft 34 than do the lobe portions 54*c*, it follows that the valve 22 will be forced open to a greater degree in FIG. 2 than in FIG. 1.

It will be appreciated that the profiles 56, 58 and 60, particularly the latter two, can be contoured or configured to coact with their respective follower surfaces 78, 80 and 82 to produce various duration and lift patterns. It should also be understood that the economy and performance operational modes achieved with the cams 48 and 50, as they have been profiled, can provide a myriad of transitional modes depending upon the specific position of the upper rocker arm 72 as determined by the position of the accelerator pedal 118. In other words, the operator can readily effect small progressively smooth movements of the valve 22 that best suit the particular load imposed upon the engine 10.

The invention is best described in relation to a single inlet valve 22. It will be recognized that there is an inlet valve 22 for each cylinder or combustion chamber 14, and that there is a cam unit 42 for each chamber 14. Obviously, while not depicted, there is also an exhaust valve for each chamber 14, the opening and closing of which is related to the opening and closing of the inlet valve 22 with which it coacts. Conventional cam arrangements can be employed for the various exhaust valves, my invention being sufficiently versatile to permit this.

I claim:

1. Apparatus for operating a reciprocable valve member for opening and closing a valve port in communication with a combustion chamber of an internal combustion engine comprising a first rocker arm, means mounting one end of said first rocker arm for pivotal movement about one axis so that a portion of said first rocker arm is engageable with said valve member, a second rocker arm, means mounting one end of said second rocker arm for pivotal movement about a second axis relatively movable with respect to said first axis, a portion of said second rocker arm being engageable with longitudinal portions of said first rocker arm, a camshaft, first and second cam means on said camshaft, said second rocker arm having a first longitudinal portion engageable by said first cam means and a second longitudinal portion engageable by said second cam means, said first and second longitudinal portions being fixedly related with respect to each other, said first and second cam means having respective profiles and said first and second longitudinal portions having respective follower configurations so that said first cam means coacts with points along said first longitudinal portion to provide a first operating mode of said valve member, in which said valve member remains closed, and said second cam means coacts with points along said second longitudinal portion to provide a second operating mode of said valve member, in which said valve member is opened and closed, the distance between said pivotal axes causing said modes to vary in relation to each other.

2. Apparatus for operating a reciprocable valve member in accordance with claim 1 in which said first pivotal axis is fixed and said second pivotal axis is shiftable relative to said first axis.

3. Apparatus for operating a reciprocable valve member in accordance with claim 2 in which said first cam means includes a base circle portion and an eccentric portion, and in which said first longitudinal portion constitutes a linear or straight line section.

4. Apparatus for operating a reciprocable valve member in accordance with claim 3 in which said second cam means has a base circle portion and a lobe portion, said lobe portion projecting radially beyond said eccentric portion, and in which said second longitudinal portion engageable by said second cam means includes a substantially straight section and a curved section, said curved section being nearer said second pivotal axis.

5. Apparatus for operating a reciprocable valve member in accordance with claim 4 including third cam means having a base circle portion and a lobe portion, the lobe portion of said third cam means extending radially to a greater extent than the lobe portion of said second cam means, and said second rocker arm having a third longitudinal portion engageable at points therealong by said third cam means, said third longitudinal portion having a straight section and a curved section, the curved section of said third longitudinal portion being spaced nearer said second pivotal axis than the curved portion of said second longitudinal portion.

6. Apparatus for operating a reciprocable valve member in accordance with claim 5 in which said first, second and third cam means constitute a single cam unit.

7. Apparatus for operating a rciprocable valve member in accordance with claim 6 in which the center of said eccentric portion and said lobe portions are angularly aligned with each other.

8. Apparatus for operating a reciprocable valve member in accordance with claim 7 including pivotal arm means and shaft means carried on said pivotal arm means, said shaft means providing said second pivotal axis.

9. Apparatus for operating a reciprocable valve member in accordance with claim 8 in which said first rocker arm has a curved ramp portion, the free end of said second rocker arm being engageable with the curved ramp portion of said first rocker arm.

10. Apparatus for operating a reciprocable valve member for opening and closing a valve port in communication with a combustion chamber of an internal combustion engine comprising movable means engageable with said valve member, said means having a non-linear ramp surface, a rocker arm engageable with said non-linear ramp surface, means mounting said rocker arm for pivotal movement about one end thereof, said mounting means bing shiftable so that the free end of said rocker arm engages selected portions of said non-linear ramp surface, and means forming a plurality of cam follower surfaces on said rocker arm, one of said follower surfaces constituting a straight line section, a second of said follower surfaces including a straight line section and a curved section, and a third of said follower surfaces including a straight section and a curved section, said last-mentioned curved section being nearer said mounting means than said first-mentioned curved section, a first cam member engageable with said one follower surface and having a base circle portion and an eccentric portion, said eccentric portion having a slightly larger radius than said base circle portion, a second cam engageable with said second follower surface and having a base circle portion and a lobe portion, said lobe portion projecting radially beyond the eccentric portion of said first cam member, and a third cam member engageable with said third follower surface and having a base circle portion and a lobe portion, the lobe portion of said third cam projecting radially beyond the lobe portion of said second cam.

11. Apparatus for operating a reciprocable valve member in accordance with claim 10 in which said first means constitutes a second rocker arm, said second rocker arm being pivotal about a fixed axis, and said mounting means for said first rocker arm providing a shiftable axis.

12. Apparatus for operating a reciprocable valve member in accordance with claim 11 including pivotal arm means, said first rocker arm being pivotally mounted at one end to said arm means, pivotal movement of said arm means providing said shiftable axis.

13. Apparatus for operating a reciprocable valve member in accordance with claim 12 in which said pivotal arm means is actuated in accordance with a desired operating mode for said internal combustion engine, the position of said first rocker arm with respect to said second rocker arm determining the time at which said valve member opens and closes and also the amount of lift of said valve member.

14. Apparatus for operating a reciprocable valve means associated with the combustion chamber of an internal combustion engine, said valve means having at least a certain amount of lash, the apparatus comprising first rotatable cam means having a base circle portion and an eccentric portion, said eccentric portion sloping radially outward from said base circle portion a distance corresponding generally to said amount of lash, said base circle and eccentric portions successively engaging said valve means as said first cam means rotates, second rotatable cam means having a lobe portion projecting radially outward a greater distance than said eccentric portion, said lobe portion also engaging said valve means as said second cam means rotates, and follower means engageable by said first and second cam means for transmitting motion from said first and second cam means to said valve means, said follower means including a shiftable stepped rocker arm formed with a first longitudinal portion having a straight section engageable by said first rotatable cam means at various points therealong depending on the position of said rocker arm relative to said first cam means and said rocker arm being formed with a second longitudinal portion having a curved section engageable by said second cam means at various points therealong depending on the position of said rocker arm relative to said second cam means, said first and second longitudinal portions being fixedly disposed relative to each other and moved in unison when said rocker arm is shifted relative to said first and second cam means.

15. Apparatus for operating a reciprocable valve member in accordance with claim 14 in which said second cam means also has a base circle portion having the same radius as the base circle portion of said first cam means.

16. Apparatus for operating a reciprocable valve member in accordance with claim 14 in which said valve means includes a lash cap.

17. Apparatus for operating reciprocable valve means in accordance with claim 14 in which said valve means includes a valve member and a spring member biasing said valve member in the direction of said follower means, said base circle portion and said eccentric portion on said first cam means acting on said follower means so that said valve member prevents gaseous flow to or from said combustion chamber, said lobe portion on said second cam means acting on said follower means to cause said valve member to open and thus permit gaseous flow to or from said combustion chamber.

18. Apparatus for operating reciprocable valve means associated with the combustion chamber of an internal combustion engine, said valve means having at least a certain amount of lash, the apparatus comprising a camshaft rotatable about a given axis, a cam unit on said camshaft, said cam unit including a first cam having a base circle portion and an eccentric portion and a second cam having a base circle portion and a lobe portion, said lobe portion projecting a greater radial distance from said camshaft axis than said base circle portion, a rocker arm having a first follower portion engageable by the base circle portion and the eccentric portion of said first cam and a second follower portion engageable by the base circle portion and the lobe portion of said second cam, the follower portion engageable by the portions of said first cam being generally linear and the follower portion engageable by the portions of said second cam including a linear section and a nonlinear section, means mounting said rocker arm for pivotal movement, and means for shifting said mounting means and said rocker arm with respect to said valve means and with respect to said camshaft axis so as to render said first cam effectual in one shifted position so that said valve means remains closed and to render said second cam means effectual in a second shifted position so that said valve means is opened by the lobe portion of said second cam.

19. Apparatus for operating reciprocable valve means in accordance with claim 18 in which said shifting means includes an accelerator pedal for shifting said rocker arm.

20. Apparatus for operating reciprocable valve means in accordance with claim 19 in which said shifting means additionally includes a hydraulic amplifier, said accelerator pedal controlling said hydraulic amplifier.

* * * * *